US005094588A

United States Patent [19]

Gros

[11] Patent Number: 5,094,588

[45] Date of Patent: Mar. 10, 1992

[54] CONCRETE STEAM CONDENSER FOR AN AXIAL EXHAUST TURBINE AND TURBINE PROVIDED WITH SAME

[75] Inventor: Jean-Pierre Gros, Villemonble, France

[73] Assignee: GEC Alsthom SA, Paris, France

[21] Appl. No.: 570,765

[22] Filed: Aug. 22, 1990

[30] Foreign Application Priority Data

Aug. 28, 1989 [FR] France ..... 8911301

[51] Int. Cl.[5] ..... F01D 25/00; F01K 9/00

[52] U.S. Cl. ..... 415/213.1; 60/692

[58] Field of Search ..... 60/690, 692; 415/213.1, 415/220, 221, 222, 223, 182.1; 417/360; 403/355, 356

[56] References Cited

U.S. PATENT DOCUMENTS

| | | | |
|---|---|---|---|
| 3,523,062 | 8/1970 | Brown | 415/213.1 |
| 3,740,168 | 6/1973 | Hug et al. | 415/213.1 |
| 3,881,843 | 5/1975 | Meylan | 415/213.1 |
| 4,204,804 | 5/1980 | Woodger | 415/213.1 |
| 4,311,016 | 1/1982 | Kaelber | 60/692 |
| 4,433,546 | 2/1984 | Andrieux | 60/692 |

FOREIGN PATENT DOCUMENTS

| | | |
|---|---|---|
| 0206135 | 12/1986 | European Pat. Off. . |
| 348187 | 1/1922 | Fed. Rep. of Germany . |
| 1432337 | 2/1966 | France . |
| 1447944 | 6/1966 | France . |
| 1015052 | 12/1965 | United Kingdom . |

*Primary Examiner*—Edward K. Look
*Assistant Examiner*—Hoang M. Nguyen
*Attorney, Agent, or Firm*—Sughrue, Mion, Zinn, Macpeak & Seas

[57] ABSTRACT

A concrete steam condenser for an axial exhaust turbine supported on a concrete foundation, is aligned with the exhaust and comprises a volume whose external concrete envelope forms a monolithic assembly with the concrete foundation. The turbine exhaust is flanged to the condenser inlet. The condenser does not require supporting or guiding. The turbine shaft responds better to deformation of the condenser. The amount of concrete used is significantly less than the volume usually used.

6 Claims, 5 Drawing Sheets

CONCRETE STEAM CONDENSER FOR AN AXIAL EXHAUST TURBINE AND TURBINE PROVIDED WITH SAME

BACKGROUND OF THE INVENTION

1. Field of the Invention

The present invention concerns a concrete steam condenser for an axial exhaust turbine and a turbine provided with same.

2. Description of the Prior Art

A concrete construction steam condenser is known but this condenser is located under the turbine. The distance between the foundation or lower part of the condenser and the axis of the turbine is then more than 12 meters.

The overall size and volume of this type of installation constitute a major disadvantage. What is more, any distortion of the condenser may compromise the dynamic quality of the shaft line as the turbine is supported on the concrete structure incorporating the condenser. A condenser of this kind is described in the document GB-A-1015052.

SUMMARY OF THE INVENTION

The present invention avoids these disadvantages and consists in a concrete steam condenser for an axial exhaust turbine supported on a concrete foundation, the condenser being aligned with the exhaust and in the form of a volume whose external envelope in concrete forms a monolithic assembly in one piece with the foundation, the turbine exhaust being flanged to the condenser inlet.

As the turbine and the condenser are at the same level, there is excellent integration between the external concrete envelope of the condenser and the foundation of the turbine, and the volume of concrete used is significantly reduced as compared with the conventional implementation. The turbine is aligned with the condenser and is not supported on the condenser structure, so that deformation of the condenser due to pressure and vacuum does not degrade the behavior of the shaft line.

DETAILED DESCRIPTION OF THE INVENTION

Figure 1:
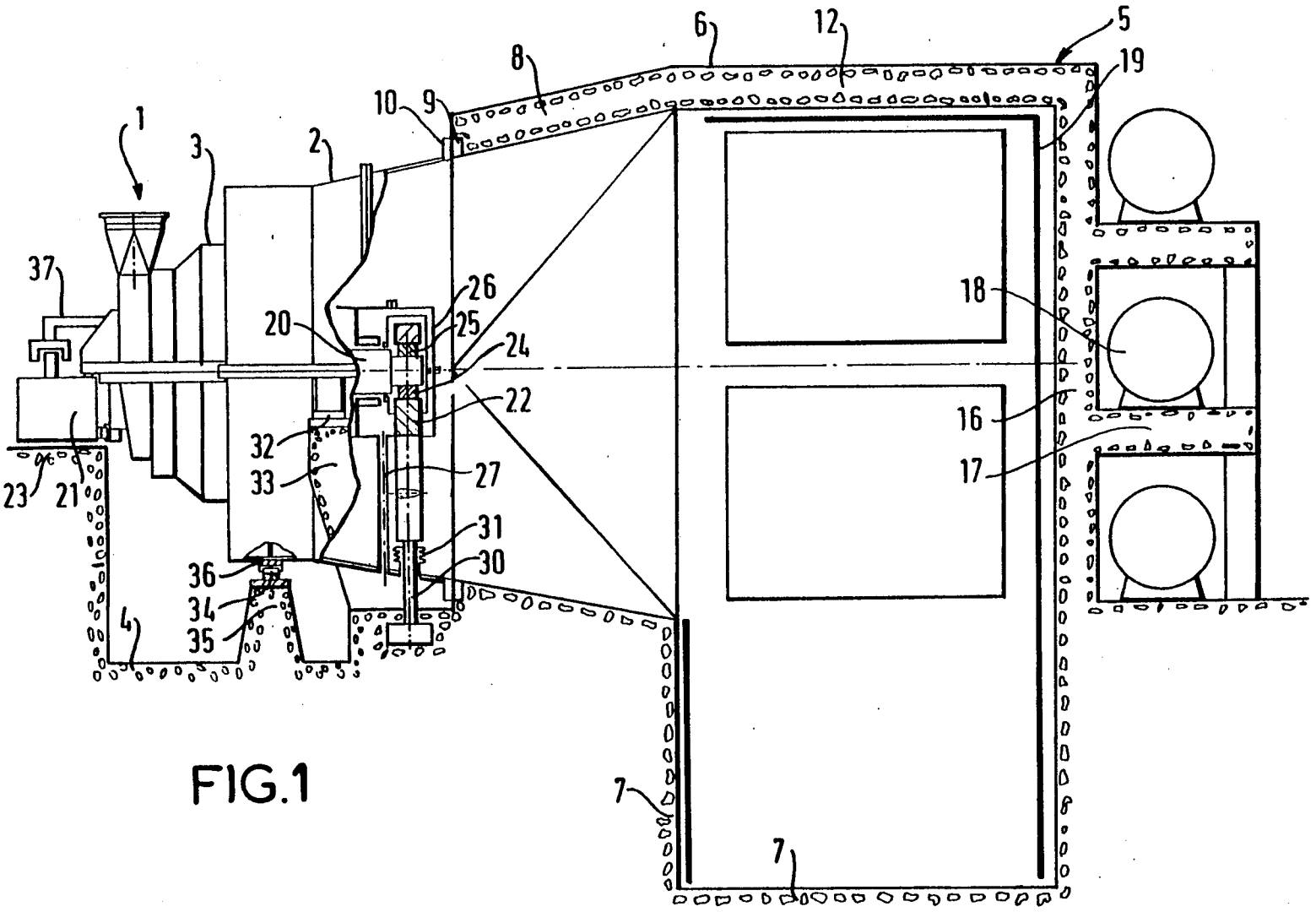
FIG. 1 shows in cross-section an axial exhaust turbine and an associated condenser in accordance with the invention.
Figure 2:
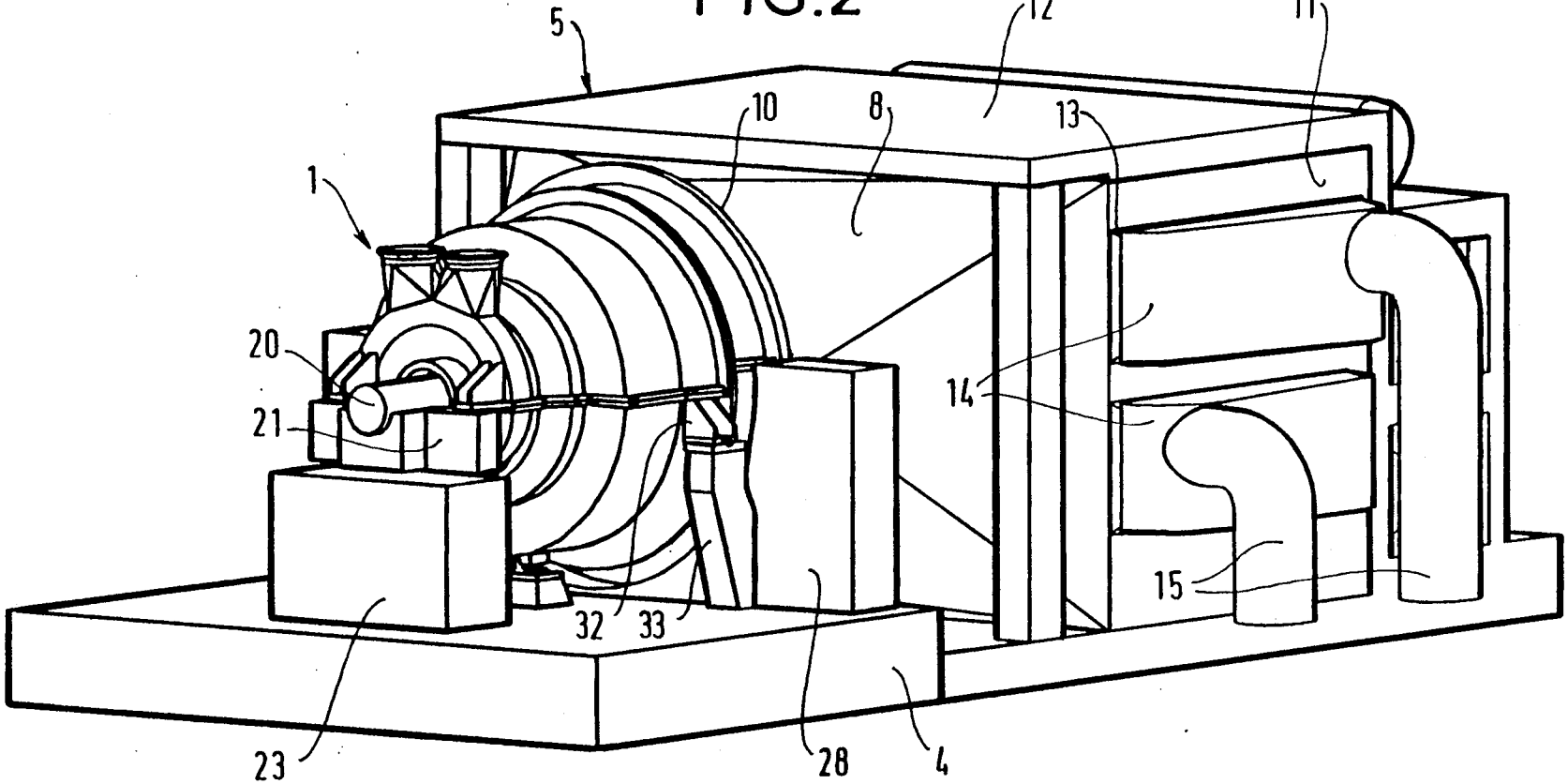
FIGS. 2 and 3 are two perspective views of the turbine and the condenser in accordance with the invention.
Figure 3:
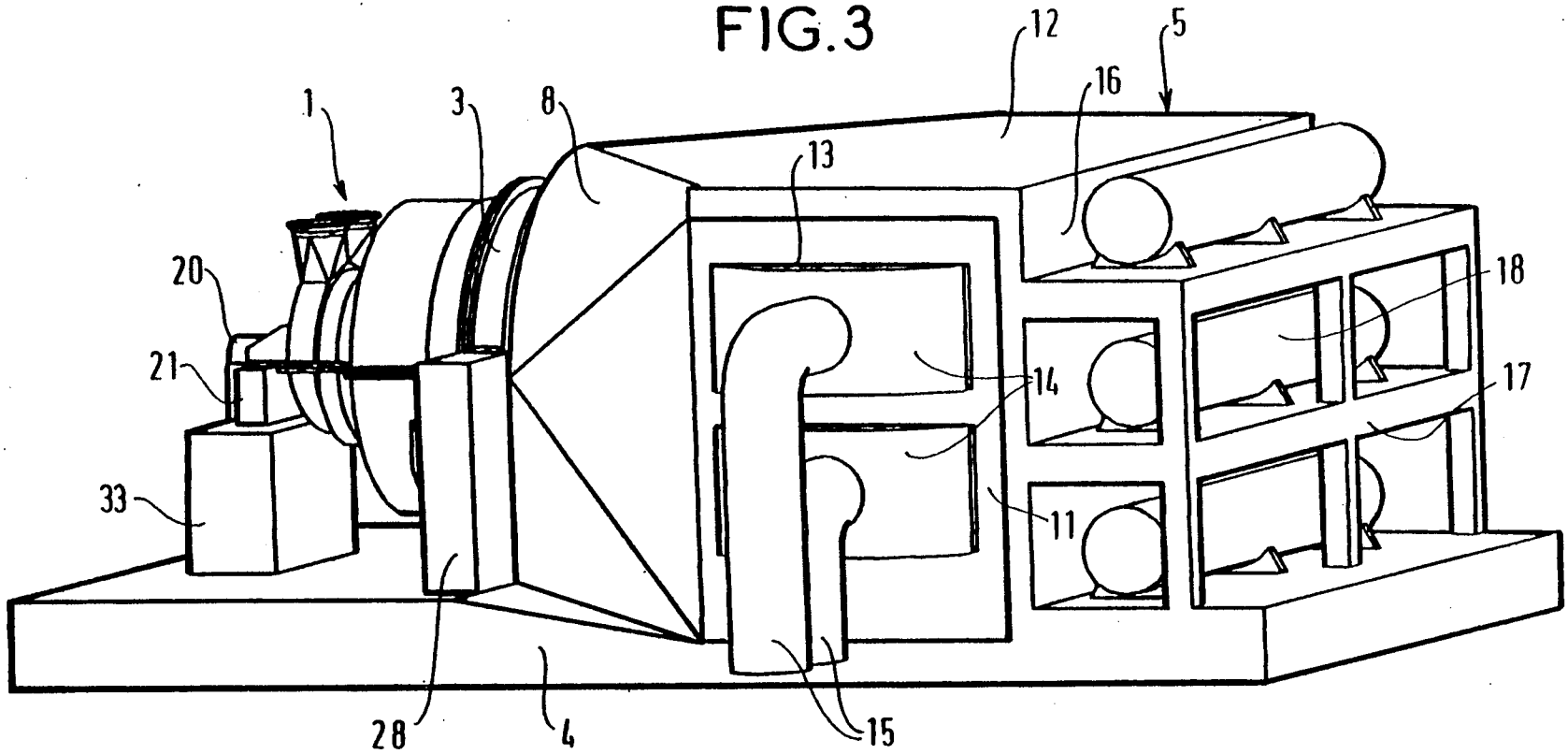
Figure 4:
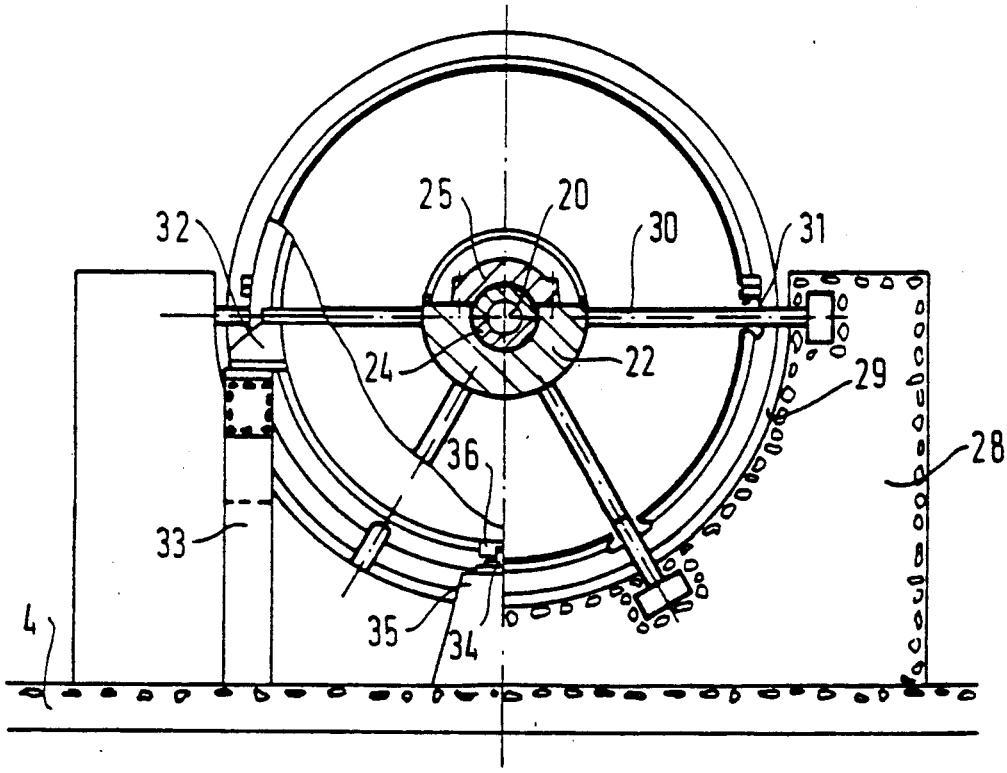
FIG. 4 is a back view of the turbine from FIG. 1.

The turbine 1 includes an axial exhaust 2 forming part of the stator 3.

It rests on a concrete foundation 4 through the intermediary of concrete supports 23, 28 and 33.

The condenser 5 has a parallelepiped shape external envelope 6 in concrete aligned with the exhaust 2.

The lower wall 7 of the condenser is formed by the foundation 4. It is disposed below the lower part of the turbine 1.

The front wall 8 forming the turbine-condenser connecting sleeve is in the shape of a truncated pyramid.

The part on the turbine side is provided with a circular flange 9 to which is fixed the flange 10 on the turbine to the rear of the exhaust 2.

The front wall 8 merges with the side walls 11 and the bottom wall 7 and the top wall 12 of the condenser.

The side walls 11 incorporate openings 13 through which pass bundles of tubes 14 in which cooling water flows. The cooling water is supplied and evacuated by pipes 15.

The rear wall 16 includes concrete supports 17 on which are supported heaters 18.

A heat shield 19 is provided on the interior concrete walls of the condenser.

The turbine shown in FIGS. 1 through 4 is the subject matter of French patent application No. 8905701 the contents of which are hereby incorporated by way of reference.

The turbine rotor 20 is supported by two bearings 21 and 22, one at the inlet end and the other in the axial exhaust 2 of the turbine 1.

The bearing 21 is supported by a concrete support 23 integral with the concrete foundation 4. It incorporates a thrust bearing 37.

The bearing 22 includes a bearing pad 24 to which are fixed a stirrup member 25 and a lining 26.

The lining 26 is vented to atmospheric pressure by a pipe 27.

In accordance with the invention, a vertical concrete wall 28 integral with the foundation 4 incorporates a semi-circular cradle 29 accommodating the lower part of the exhaust 2.

The bearing 22 is supported by four radial tie-rods 30 and located in a vertical plane perpendicular to the rotor axis.

Two tie-rods are horizontal and the other two are directed downwardly at an angle of 60° to the adjacent tie-rods.

The tie-rods 30 are anchored at their ends into the thickness of the wall 28 around the cradle.

The tie-rods 30 are fitted with sealing bellows 31 where they pass through the wall of the exhaust 2.

The exhaust 2 is provided with two lateral lugs 32 which rest on two concrete supports 33 integral with the foundation 4.

The device which centers the exhaust 1 includes a key 34 mounted on a concrete support 35 integral with the foundation 4, said key 34 being trapped in a slideway 36 parallel to the axis of the turbine and fastened to the exhaust 2.

The supports 23, 33, 35 and the wall 28 are preferably in concrete and directly integrated with the foundation to constitute with it a unitary construction.

Bearing forces are no longer transmitted through the exhaust since the tie-rods 30 are fixed to the concrete wall 28; the system in accordance with the invention is particularly simple and can withstand high degrees of accidental unbalance.

The turbine-condenser linkage is made by means of the flanges 9 and 10. The external forces due to atmospheric pressure are absorbed by the exhaust 2 of the turbine 1 and the external envelope 6 of the condenser.

The point of departure for axial expansion of the stator 3 of the turbine 1 is the plane of the flange 9.

The stator 2 can entrain the thrust bearing 37 in the bearing 21 to minimise the effects of differential expansion of the rotor 20 and the stator 2.

There is obtained in this way a monolithic concrete structure for the foundation 4 of the turbine, the external envelope 6 of the condenser 5 and the supporting arrangement 17 for the heaters 18.

The coupling between the turbine 1 and the condenser 5 is very simple (bolted flanges) and it is not necessary to provide condenser supports and guide means.

Figure 5:
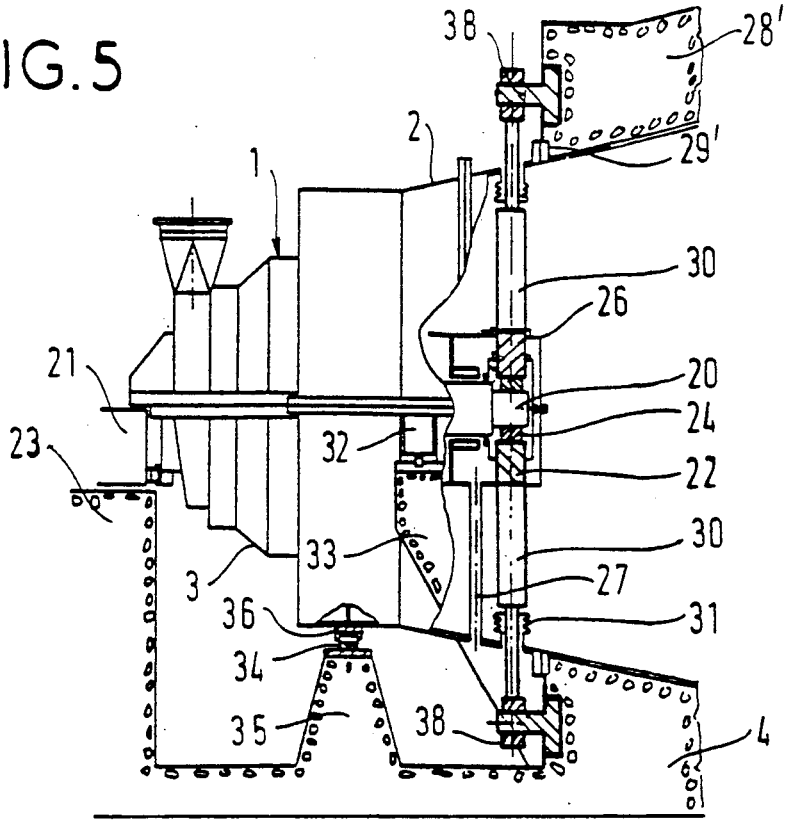
FIGS. 5 and 6 show a modified form of the turbine from FIG. 1 in side and back view.
Figure 6:
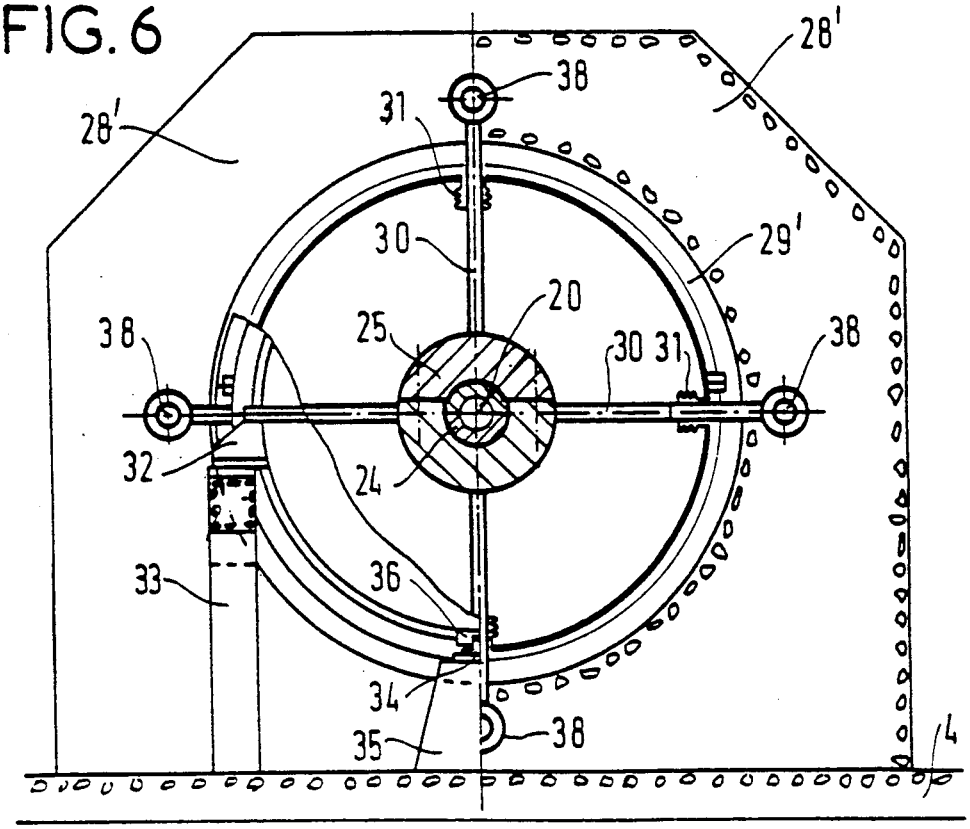

FIGS. 5 and 6 concern an alternate turbine described in more detail in U.S. patent application Ser. No. 515,023 the contents of which are hereby incorporated by way of reference.

Parts similar to parts of the turbine described in FIGS. 1 through 4 carry the same reference numbers.

In this version the vertical concrete wall 28 is the point of departure of the concrete structure of the condenser previously described. It is provided with a circular opening 28' to which the exhaust 2 of the turbine 1 is fixed.

Four studs 38 uniformly distributed about the opening 29' are attached to the wall 28, The ends of four tie-rods 30 supporting the bearing 22 and its stirrup member 25 are removably attached to these studs 38.

I claim:

1. Concrete steam condenser for an axial exhaust turbine supported on a concrete foundation, the condenser being aligned with an exhaust of the turbine and comprising a volume whose external concrete envelope forms a monolithic assembly with the concrete foundation, the turbine exhaust being flanged to the condenser inlet.

2. Condenser according to claim 1 wherein the front wall is in the form of a truncated pyramid the central part of which constitutes the condenser inlet and is fitted with a flange to which is fixed the outlet flange of the exhaust and the periphery of which merges with the lower and upper walls, two lateral walls being provided with openings through which pass bundles of tubes in which cooling water flows.

3. Turbine provided with a concrete steam condenser for an axial exhaust turbine supported on a concrete foundation, the condenser being aligned with an exhaust of the turbine and comprising a volume whose external concrete envelope forms a monolithic assembly with the concrete foundation, the turbine exhaust being flanged to the condenser inlet, in which turbine the exhaust comprises internally a bearing supporting the rotor, said bearing is supported by radial tie-rods which pass through the exhaust and are fixed at their end into a vertical wall integral with the foundation, said wall is provided with a cradle in which the lower part of the exhaust is accommodated, and said exhaust is provided with lugs resting on concrete supports integral with the foundation.

4. Turbine provided with a concrete steam condenser for an axial exhaust turbine supported on a concrete foundation, the condenser being aligned with an exhaust of the turbine and comprising a volume whose external concrete envelope forms a monolithic assembly with the concrete foundation, the turbine exhaust being flanged to the condenser inlet, in which turbine the exhaust comprises internally a bearing supporting the rotor, said bearing is supported by radial tie-rods which pass through the exhaust and are flanged at their end to the vertical wall integral with the foundation and the condenser, said wall is provided with an opening through which the exhaust steam passes, and said exhaust is provided with lugs resting on concrete supports integral with the foundation.

5. Turbine according to claim 3 wherein the exhaust is centered transversely by a key device.

6. Turbine according to claim 3 wherein the rear wall of the condenser is provided with horizontal concrete supports which support heaters.

* * * * *